United States Patent [19]

Kaede et al.

[11] Patent Number: 4,985,092

[45] Date of Patent: Jan. 15, 1991

[54] STEEL HAVING GOOD WEAR RESISTANCE

[75] Inventors: Hiroshi Kaede, Nagoya; Tadahiro Koike, Tokai; Shinji Kato, Okazaki; Yorishige Maeda; Yoshio Fuwa, both of Toyota; Shigetoshi Sugimoto, Aichi; Hikaru Aoyagi; Shinzi Shibata, both of Toyota, all of Japan

[73] Assignees: Aichi Steel Works, Limited, Tokai; toyota Jidosha Kabushiki Kaisha, Toyota, both of Japan

[21] Appl. No.: 508,537

[22] Filed: Apr. 11, 1990

Related U.S. Application Data

[60] Continuation-in-part of Ser. No. 329,318, Mar. 27, 1989, abandoned, which is a division of Ser. No. 204,729, Jun. 10, 1988.

[30] Foreign Application Priority Data

Jun. 11, 1987 [JP] Japan ..... 62-146000
Sep. 11, 1987 [JP] Japan ..... 62-230446

[51] Int. Cl.[5] ..... C22C 38/18

[52] U.S. Cl. ..... 148/326; 148/325; 148/319; 420/62; 420/34

[58] Field of Search ..... 148/326, 325, 318, 319; 420/62, 34, 70

[56] References Cited

U.S. PATENT DOCUMENTS

| | | | |
|---|---|---|---|
| 2,201,425 | 5/1940 | Berglund | 420/38 |
| 3,575,737 | 4/1971 | Carlen | 148/12.4 |
| 3,859,147 | 1/1975 | Philip | 148/326 |
| 3,990,892 | 11/1976 | Machi et al. | 420/69 |
| 4,490,175 | 12/1984 | Matsuzaki | 420/69 |

FOREIGN PATENT DOCUMENTS

| | | | |
|---|---|---|---|
| 583698 | 1/1925 | France . | |
| 619937 | 4/1927 | France . | |
| 56-47545 | 4/1981 | Japan | 148/324 |
| 56-81243 | 7/1981 | Japan . | |
| 56-98453 | 8/1981 | Japan . | |
| 58-45357 | 3/1983 | Japan . | |
| 59-162346 | 9/1984 | Japan . | |
| 60-258408 | 12/1985 | Japan | 148/324 |
| 61-144470 | 7/1986 | Japan . | |
| 62-23969 | 1/1987 | Japan . | |
| 62-136555 | 6/1987 | Japan . | |

*Primary Examiner*—Deborah Yee
*Attorney, Agent, or Firm*—Oblon, Spivak, McClelland, Maier & Neustadt

[57] ABSTRACT

A steel having good wear resistance which contains 0.55–1.10% of C, up to 2.0% of Si, up to 2.0% of Mn, 12.0–25.0% of Cr and particularly suitable as a material for piston rings or rocker arms. Further addition of 0.05–1.10% of Al to the above steel gives a steel improved in properties for spheroidization of carbides and uniformization of carbide particle size, leading to further enhancement of wear resistance. If required 0.20–2.0% of Ni may be added to the steels, whereby corrosion resistance, toughness and hardenability are improved. An addition of at least one of 0.2–3.0% of Mo, 0.1–1.5% of V and 0.05–0.70% of Nb to the steels improves high-temperature strength and surface hardness. The steel is surface treated by gas nitriding of the like in a surface area for sliding contact with an opponent member.

8 Claims, 4 Drawing Sheets

STEEL HAVING GOOD WEAR RESISTANCE

This application is a continuation of application Ser. No. 07/329,318, filed on Mar. 27, 1989, now abandoned; which is a divisional application of Ser. No. 07/204,729 filed on June 10, 1988.

BACKGROUND OF THE INVENTION

1. Field of the Invention

The present invention relates to a steel having good wear resistance, and more particularly to a steel and wrought steel having good wear resistance suitable for use as a material for piston rings and rocker arms of internal combustion engines, and pinion shafts for differential gears, all for parts of automobiles, as well as good fitting strength and fatigue strength.

2. Description of the Prior Art

Piston rings used for internal combustion engines consist of compression rings for maintaining the gas-tightness of combustion chambers and oil scraper rings for conditioning lubricating oil films on the wall surfaces of cylinders or cylinder liners of the engines. Of the piston rings, the compression rings are loosely fitted directly below a piston head and heavily affected by a combustion gas. Therefore, the compression rings are required to be resistant to wear (abrasive wear under the action of carbon soot and corrosive wear under the action of corrosive combustion products), scuffing, heat, etc.

With the recent trend toward internal combustion engines with lighter weight, higher outputs and higher rotating speed, development of piston rings with smaller width has been positively made. The reduction in the width of the piston ring makes it possible to reduce the weight of the piston ring, stabilize the behavior of the piston ring in a piston ring groove and to decrease the thickness of the oil film, thereby improving the lubricating oil consumption.

However, the development of the piston rings with smaller width is accompanied by a reduction in the oil film thickness, an increase of wear of the rings and a shortening of the service life of the rings. Therefore, it has become impossible to use rings made of cast iron, which have hitherto been generally used, or rings made from carbon steel, silicon-chromium steel or oil-tempered wire. Namely, rings made of cast iron have the drawback that it is difficult to produce rings smaller in size in the axial direction and the breaking strength thereof is unsatisfactory. The silicon-chromium rings are formed relatively large in cross-sectional area, in view of the poor high-temperature strength of silicon-chromium steel, and have a great inertia, which will bring about the fluttering phenomenon. Therefore, tool steels, spring steels and stainless steels have recently come to be used as materials for piston rings. Of stainless steels, particularly, 13Cr martensitic stainless steel (0.65C-13.5Cr-0.3Mo-0.1V) has been used for compression rings to give good results. On the other hand, the oil ring has the important function of appropriately controlling the amount of the lubricating oil at the time of sliding contact between the piston rings and the cylinder and scraping off excess lubricating oil to prevent it from penetrating into the combustion chamber. Therefore, side rails for the oil ring are, like the compression rings, required to have heat resistance and wear resistance. The same material as that for the compression rings has been used for the side rails to give good results.

The piston rings made of the martensitic stainless steel, however, are not satisfactory in wear resistance and scuffing resistance when used for engines in which severe abrasive wear takes place. Compression rings made from martensitic stainless steel and subjected to a gas nitriding treatment are unsatisfactory in strength of fitting to the piston, and has the problem that they may be broken when the joint gap is excessively widened (to 10T or above, effective durability being 11–13T, where T is thickness (mm) of ring). Further, such compression rings have the drawback of being unsatisfactory in scuffing resistance and, therefore, being scuffed when used for internal combustion engines in which scuffing resistance requirements are severe. Accordingly, a thin Ni-P or Ni-Co-P plating or such base plating with hard particles (e.g., $Si_3N_4$) dispersed therein has been provided only on a sliding surface of the compression ring. In view of the above, in connection with the piston rings made of martensitic stainless steel there has been a demand for further higher wear resistance and scuffing resistance in order to prolong the service life of the piston rings.

In the internal combustion engines, rocker arms are operated in abutment with a cam shafts. As the cam shafts rotate in high rotational speed, the rocker arms are required to be resistant to wear and scuffing.

Further, other shafts used in automobiles and operated under severe sliding condition with heavy load, such as pinion shafts of pinion gears used in differential gear device for front-engine front-wheel-drive vehicles, are required to be resistant in seizure and to wear.

SUMMARY OF THE INVENTION

It is primary object of the present invention to provide a martensitic stainless steel having good wear resistance.

It is an object of the present invention to provide a martensitic stainless steel for use as a material for piston rings and rocker arms, and pinion shafts for differential gears, all for parts of automobiles, which has good wear resistance.

It is another object of the present invention to provide a wrought steel for use as a material for piston rings, rocker arms, pinion shafts and so on which has good wear resistance, fitting strength and fatigue strength and is particularly suitable for achieving enhancement of the output and rotating speed of internal combustion engines.

It should be understood that the term "piston rings" used in the present invention includes the meanings of compression springs, oil rings and side rails assembled to the oil ring.

The steel according to the present invention consists essentially of, by weight, 0.55–1.10% of C, up to 2.0% of Si, up to 2.0% of Mn, 12–25% of Cr and the balance of Fe and inevitable impurities.

The present inventors have made intensive studies of the wear resistance of conventional martensitic stainless steels, with an idea that an increase in the amount of chromium carbide will be effective in improving the wear resistance of the steels. As a result of the studies, the present inventors have found out optimum ranges of contents of C, Si, Mn, etc. in connection with the content of Cr in the martensitic stainless steel.

According to the present invention, chromium carbide is formed in the steel in a larger amount than in conventional steels by increasing the Cr content, to thereby improve the wear resistance of the steel. Besides, C is added to the steel in an amount sufficient to form carbides, and the upper limits of the C content as well as Si and Mn contents are set in such ranges as not to spoil cold workability of the steel. Though the steel according to the present invention displays sufficient wear resistance when used as it is, it is preferable to use the steel after a heat treatment, namely, a quenching and tempering treatment or a quenching treatment (in the latter case, a subsequent nitriding treatment serves also as a tempering treatment). The effect of improving the wear resistance can be further enhanced greatly when the steel thus heat treated is subjected to a surface treatment such as nitriding, plating, thermal spraying, etc. The surface treatment is applied to a surface including a sliding surface, and may be any of a nitriding treatment such as gas nitriding, gas soft nitriding, ion nitriding, salt bath nitriding, etc., plating such as Cr plating, composite plating, etc., coating with ceramic such as TiN, TiCxNy, TiC, etc. by physical vapor deposition (PVD) or chemical vapor deposition (CVD), metal spraying, etc.

According to the present invention, further, 0.2–2.0% of Ni may be added to the steel, if required, to enhance high-temperature strength, hardenability and corrosion resistance, and at least one of 0.2–3.0% of Mo, 0.1–1.5% of V and 0.05–0.70% of Nb may be added to the steel, if required, to refine the carbide particles and further improve the wear resistance.

Moreover, the present inventors have found that an addition of Al to the above-mentioned martensitic stainless steel makes it possible to remarkably improve the wear resistance without lowering in hot and cold workability at the stages of production of wires from an ingot of the steel. The present inventors have then found that an addition of 0.05–1.10% of Al, in connection with the contents of C, Si, Mn, Cr and the like, enhances markedly the wear resistance and scuffing resistance of the steel and lessens the wear of the opponent member. When the addition of Al is accompanied by an addition of 0.2–2.0% of Cu, as required, it is possible to enhance corrosion resistance and oxidation resistance of the steel.

BRIEF DESCRIPTION OF THE DRAWINGS

Various other objects, features and attendant advantages of the present invention will be more fully appreciated as the same becomes better understood from the following detailed description when considered in connection with the accompanying drawings, in which.

DETAILED DESCRIPTION OF THE PREFERRED EMBODIMENTS

Figure 1:
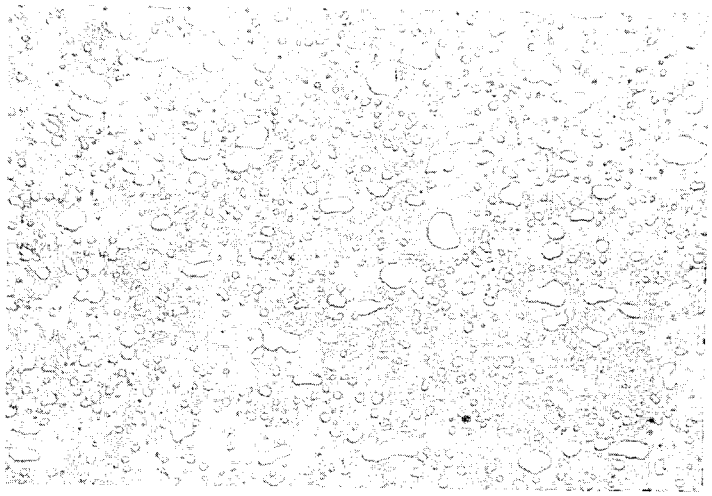
FIG. 1 is a micrograph (400 magnifications) showing the metallic structure of a steel according to the present invention.

The present invention relates to a steel having good wear resistance which consists essentially of, by weight, 0.55–1.10% of C, up to 2.0% of Si, up to 2.0% of Mn, 12.0–25.0% of Cr and the balance of Fe and inevitable impurities.

The steel according to the present invention can be improved in corrosion resistance, toughness and hardenability by incorporating 0.20–2.0% of Ni into the steel in addition to the above-mentioned chemical components, or can be improved in high-temperature strength and surface hardness by the addition of at least one of 0.2–3.0% of Mo, 0.1–1.5% of V and 0.05–0.70% of Nb to the steel.

The steel according to the present invention can be enhanced in wear resistance and scuffing resistance by incorporating 0.05–1.10% of Al into the steel in addition to the above-mentioned chemical components. When the addition of Al is accompanied by an addition of 0.2–2.0% of Cu, it is possible to enhance corrosion resistance and oxidation resistance of the steel.

The properties of the chemical components of the steel according to the present invention and the reasons for the limitations of the contents of the components will now be explained below.

C; 0.5–1.10%

Carbon is an element for obtaining a desired hardness on quenching and for forming carbides to provide high strength and wear resistance. If the C content is less than 0.55%, the amount of the carbides formed are small, and the wear resistance obtained by the presence of the carbides is poor. If the C content exceeds 1.10%, on the other hand, the particle size of the carbides is increased, resulting in abrasion of the cylinder liner (opponent member of the piston ring), and it is impossible to shape the steel into the piston ring by cold working. Therefore, the upper limit of the C content is set at 1.10%. In order to obtain an optimum hardness (Hv 350 to 450), a C content at least 0.80% is preferred.

Si; 0.10–2.0%

Silicon is added at the time of refining as a deoxidizing agent, and serves to provide heat resistance. An addition of at least 0.10% of Si is necessary for obtaining the effects. However, an addition of a large amount of Si impairs cold workability such as drawability of the steel. Thus, the upper limit of the Si content is set at 2.0%.

Mn; 0.10–2.0%

Manganese is added at the time of refining as a deoxidizing agent, just like Si, and serves to increase toughness. An addition of at least 0.10% of Mn is required for obtaining these effects. However, an addition of a large amount of Mn impairs cold workability of the steel. Therefore, the upper limit of the Mn content is set at 2.0%.

Cr; 12.0–25.0%

Chromium combines with carbon to form a carbide, thereby enhancing wear resistance, and serves also to enhance corrosion resistance and matrix strength and to increase the hardness of the nitrided hardened case. If the Cr content is less than 12.0%, the effects of the Cr addition, particularly the enhancement of wear resistance, cannot be displayed satisfactorily. Thus, the lower limit of the Cr content is 12.0%. However, if Cr is added in a large amount, the effects are not conspicuously displayed and toughness is lowered, resulting in poor cold workability. Therefore, the upper limit of the Cr content is set at 25.0%. The Cr content may be 19.5–25.0% in the case where Al is not added to the steel.

Ni; 0.2–2.0%

Nickel serves to provide corrosion resistance, toughness and hardenability. Particularly in the case of the addition of Al, which has a high tendency to form ferrite, nickel serves to prevent formation of ferrite at high temperatures and improve hardenability and hot workability. Since these effects are low if the Ni content is less than 0.2%, the lower limit of the Ni content is 0.2%. On the other hand, a Ni content of more than 2.0% impairs cold workability of the steel. Thus, the upper limit of the Ni content is set at 2.0%.

Mo; 0.2–3.0%

Molybdenum, like Cr, forms a carbide to enhance the hardness of the nitrided case upon nitriding, thereby enhancing wear resistance, and serves also to increase high-temperature strength of the steel. To obtain these effects, a Mo content of at least 0.2% is required. However, when the Mo content is more than 3.0%, the effects become inconspicuous and hot workability is degraded. Therefore, the upper limit of the Mo content is set at 3.0%.

V; 0.10–1.50%, Nb; 0.05–0.70%

Vanadium and niobium serve to increase resistance to softening on tempering and high-temperature strength as well as to refine carbides, and they form nitrides on nitriding, thereby enhancing the case hardness. To obtain these effects, at least 0.10% of V or at least 0.05% of Nb is required. However, if more than 1.5% of V or more than 0.70% of Nb is contained in the steel, coarse eutectic carbides are formed to deteriorate hot workability. Therefore, the upper limits of V and Nb contents are set at 1.5% and 0.70%, respectively.

Al; 0.05–1.10%

Aluminum is dissolved into the matrix in a quenching and tempering process, and, through grain refining, it increases the strength of the matrix, thereby enhancing wear resistance and scuffing resistance. As mentioned above, Al enhances wear resistance and scuffing resistance through spheroidizing the carbides and uniformizing the particle size, upon the quenching and tempering process. Besides, the Al dissolved in the matrix precipitates as fine AlN on gas nitrization to remarkably increase the hardness of the nitrided layer, thereby markedly enhancing the wear resistance and scuffing resistance and preventing increase of the abrasion of the cylinder bore. Further, the strength displayed at the time of a joint gap enlarging test is remarkably enhanced. To obtain these effects, it is necessary to add at least 0.05% of Al, and the effects are increased as the amount of Al added increases. An Al content of more than 1.10% renders the effects inconspicuous and causes formation of inclusions of $Al_2O_3$, resulting in deterioration of surface properties on hot and cold rolling (marked reduction in hardness when surface flaws remain), reductions in strength and heat resistance, and embrittlement of the nitrided case. Therefore, the upper limit of the Al content is set at 1.10%.

Cu; 0.2–2.0%

Copper serves to enhance corrosion resistance and oxidation resistance of the steel, and strengthens the matrix. To obtain these effects, an addition of at least 0.2% of Cu is necessary. However, if more than 2.0% of Cu is added, hot workability is impaired and resistance to nitriding is increased. Thus, the upper limit of Cu content is set at 2.0%. The Cu content may be 0.2–1.0% where Al is not added to the steel.

Table 1 shows the chemical compositions of steels according to the present invention and a comparative steel served to an abrasion test and a seizure test. In the table, steels A01 to A34 are steels according to the present invention, and steel B1 is 13Cr martensitic stainless steel conventionally used for piston rings, prepared by way of comparison.

Each of the steels to be served to abrasion test and seizure or galling or scaring test was melted in an electric furnace, cast, hot rolled, and then quenched and tempered (target hardness Hv350–450). From the thus treated steels, 10×15.7×6.3 mm test pieces for abrasion test and 30×30×5 mm test pieces for seizure test were prepared. The test pieces for abrasion test thus obtained were served to the abrasion test under the following conditions.

| Abrasion test on LFW-1 abrasion tester | |
|---|---|
| Opponent member: | FC25 (Japanese Industrial standard) |
| Load: | 60 kg |
| Time: | 120 min |
| Speed: | 0.3 m/sec |
| Lubricating oil: | low-viscosity engine oil (supplied 1.5 cc/min) |

The abrasion loss at the sliding surface of each test piece tested was measured. The results are shown in Table 2.

TABLE 1

| | Chemical composition (wt %) | | | | | | | | | |
|---|---|---|---|---|---|---|---|---|---|---|
| Test steel | C | Si | Mn | Ni | Cr | Mo | V | Nb | Al | Cu |
| A01 | 0.62 | 0.31 | 0.45 | | 19.9 | | | | | |
| A02 | 0.68 | 0.48 | 0.42 | | 22.0 | | | | | |
| A03 | 1.05 | 0.28 | 0.32 | | 23.5 | | | | | |
| A04 | 0.85 | 0.43 | 0.44 | 0.95 | 19.9 | | | | | |
| A05 | 0.96 | 0.35 | 0.47 | 1.15 | 22.0 | | | | | |
| A06 | 1.05 | 0.39 | 0.34 | 1.05 | 24.5 | | | | | |
| A07 | 0.63 | 0.32 | 0.45 | | 20.0 | 2.54 | | | | |
| A08 | 0.65 | 0.36 | 0.47 | | 22.1 | 1.05 | | 0.36 | | |
| A09 | 0.62 | 0.34 | 0.41 | | 24.3 | 0.35 | 0.32 | | | |
| A10 | 1.05 | 0.28 | 0.38 | 1.02 | 19.8 | 2.54 | | | | |

TABLE 1-continued

| Test steel | Chemical composition (wt %) | | | | | | | | | |
|---|---|---|---|---|---|---|---|---|---|---|
| | C | Si | Mn | Ni | Cr | Mo | V | Nb | Al | Cu |
| A11 | 1.00 | 0.45 | 0.32 | 1.58 | 23.5 | 1.08 | | 0.39 | | |
| A12 | 1.05 | 0.23 | 0.48 | 1.82 | 24.5 | 2.58 | 0.34 | | | |
| A13 | 0.88 | 0.43 | 0.45 | | 20.8 | | | | | |
| A14 | 0.96 | 0.33 | 0.41 | | 21.7 | | | | | |
| A15 | 0.87 | 0.31 | 0.41 | | 21.3 | | 0.72 | | | |
| A16 | 0.94 | 0.52 | 0.36 | | 22.3 | 1.01 | 0.35 | 0.25 | | |
| A17 | 1.06 | 0.38 | 0.38 | 22.3 | 1.01 | 0.35 | 0.25 | | | |
| A18 | 0.89 | 0.42 | 0.52 | 0.89 | 21.2 | 0.95 | 0.55 | | | |
| A19 | 0.95 | 0.37 | 0.37 | 1.31 | 22.0 | 1.13 | 0.45 | 0.29 | | |
| A20 | 0.61 | 0.30 | 0.44 | | 19.8 | | | | 1.00 | |
| A21 | 0.91 | 0.32 | 0.42 | | 21.2 | | | | 0.31 | |
| A22 | 0.95 | 0.29 | 0.35 | | 13.7 | | | | 0.95 | |
| A23 | 1.05 | 0.28 | 0.36 | 1.52 | 24.5 | 2.48 | 0.32 | | 0.30 | |
| A24 | 0.95 | 0.30 | 0.32 | 0.98 | 21.2 | 0.32 | 0.10 | 0.29 | 0.31 | |
| A25 | 0.92 | 0.34 | 0.30 | 0.48 | 19.8 | 0.12 | 0.08 | 0.31 | 0.50 | 0.52 |
| A26 | 0.91 | 0.32 | 0.34 | 0.72 | 21.1 | 0.28 | | | 0.34 | |
| A27 | 0.63 | 0.35 | 0.47 | 1.43 | 13.8 | | | | 0.85 | |
| A28 | 0.88 | 0.46 | 0.53 | | 17.2 | 0.46 | | | 0.41 | |
| A29 | 0.83 | 0.42 | 0.65 | | 19.4 | | 0.38 | | 0.35 | |
| A30 | 1.02 | 0.54 | 0.46 | | 18.3 | | | 0.38 | 0.55 | |
| A31 | 0.69 | 0.39 | 0.55 | 0.87 | 15.5 | 1.24 | | | 0.59 | 0.35 |
| A32 | 0.75 | 0.43 | 0.46 | 0.45 | 20.1 | | 0.26 | | 0.43 | |
| A33 | 0.68 | 0.40 | 0.38 | | 17.1 | | 0.13 | 0.15 | 0.26 | |
| A34 | 0.84 | 0.33 | 0.53 | | 21.7 | | | 0.24 | 0.53 | 1.25 |
| B1 | 0.63 | 0.38 | 0.39 | | 13.0 | 0.35 | | | | |

Then, other test pieces for abrasion test were subjected to gas nitriding by heating in an ammonium gas stream at 530° to 590° C. for at least 5 hours. After the gas nitriding, the surface hardness of the test pieces was measured to be at least Hv 1000. The gas-nitrided test pieces for abrasion test were served to the abrasion test under the same conditions as above. The abrasion loss at the sliding surface of each test piece tested was measured, the results being also shown in Table 2.

Subsequently, the test pieces for seizure test were served to the seizure test under the following conditions, the seizure load measured being also shown in Table 2.

| Seizure test on mechanical testing laboratory type frictional abrasion tester | |
|---|---|
| Opponent member: | FC25 (Japanese Industrial Standard) |
| Load: | Incremented by 25 kg at 2-min interval until seizure occurs. |
| Speed: | 1.2 m/sec |
| Lubricating oil: | Dropwise lubrication with low-viscosity engine oil |
| Seizure load: | The load causing a sharp increase of frictional coefficient to or above 0.2 is taken as seizure load. |

Of the comparative steels shown in Table 2, specimen B2 is one obtained by applying hard chromium plating to the surface of the test piece of steel B1; the hard chrominum plating was tested for abrasion depth and seizure load.

TABLE 2

| Specimen (steels) | Abrasion test (depth of abrasion, μm) | | | Seizure test (seizure load, kg) | | | Enlarged amount of joint gap causing breakage of gas-nitrided ring (mm) | Fatigue strength gas-nitrided specimen (50 kg/mm$^2$) | Hardness after nitriding Hmv (100 g) |
|---|---|---|---|---|---|---|---|---|---|
| | Quenched and Tempered | Surface treated by gas-nitriding | Plated with Cr | Quenched and Tempered | Surface treated by gas nitriding | Plated with Cr | | | |
| A01 | 3.40 | 2.20 | | 125.0 | 150.0 | | ≧20T | | |
| A02 | 2.70 | 1.80 | | 125.0 | 150.0 | | ≧20T | | |
| A03 | 2.20 | 1.50 | | 137.5 | 167.5 | | ≧20T | | |
| A04 | 3.20 | 1.70 | | 137.5 | 167.5 | | ≧20T | $7 \times 10^5$ | |
| A05 | 2.40 | 1.30 | | 137.5 | 167.5 | | ≧20T | $5 \times 10^5$ | |
| A06 | 1.80 | 0.80 | | 150.0 | 187.5 | | ≧20T | $5 \times 10^5$ | |
| A07 | 3.30 | 2.00 | | 137.5 | 167.5 | | ≧20T | | |
| A08 | 2.50 | 1.60 | | 137.5 | 167.5 | | ≧20T | | |
| A09 | 1.90 | 0.90 | | 137.5 | 175.0 | | ≧20T | | |
| A10 | 3.10 | 1.60 | | 150.0 | 187.5 | | ≧20T | $7 \times 10^5$ | |
| A11 | 1.90 | 0.90 | | 150.0 | 187.5 | | ≧20T | $5 \times 10^5$ | |
| A12 | 1.70 | 0.70 | | 150.0 | 187.5 | | ≧20T | $5 \times 10^5$ | |
| A13 | 2.50 | 1.70 | | 125.0 | 150.0 | | ≧20T | | 1345 |
| A14 | 2.40 | 1.60 | | 137.5 | 167.5 | | ≧20T | | 1337 |
| A15 | 2.30 | 1.30 | | 137.5 | 167.5 | | ≧20T | | 1364 |
| A16 | 2.30 | 1.10 | | 137.5 | 167.5 | | ≧20T | | 1348 |
| A17 | 2.20 | 0.90 | | 150.0 | 175.0 | | ≧20T | | 1356 |
| A18 | 2.20 | 1.10 | | 150.0 | 187.5 | | ≧20T | $7 \times 10^5$ | 1332 |
| A19 | 2.10 | 0.80 | | 150.0 | 187.5 | | ≧20T | $7 \times 10^5$ | 1337 |
| A20 | 2.50 | 1.10 | | 150.0 | 187.5 | | ≧20T | | 1450 |
| A21 | 1.80 | 0.90 | | 137.5 | 175.0 | | ≧20T | | 1335 |

TABLE 2-continued

| Specimen (steels) | Abrasion test (depth of abrasion, μm) Quenched and Tempered | Surface treated by gas-nitriding | Plated with Cr | Seizure test (seizure load, kg) Quenched and Tempered | Surface treated by gas nitriding | Plated with Cr | Enlarged amount of joint gap causing breakage of gas-nitrided ring (mm) | Fatigue strength gas-nitrided specimen (50 kg/mm$^2$) | Hardness after nitriding Hmv (100 g) |
|---|---|---|---|---|---|---|---|---|---|
| A22 | 4.00 | 2.00 | | 137.5 | 167.5 | | ≧20T | | 1425 |
| A23 | 1.20 | 0.20 | | 150.0 | 187.5 | | ≧20T | | 1345 |
| A24 | 1.60 | 0.75 | | 137.5 | 167.5 | | ≧20T | | 1337 |
| A25 | 2.40 | 0.90 | | 137.5 | 167.5 | | ≧20T | $2 \times 10^6$ | 1364 |
| A26 | 1.70 | 0.80 | | 137.5 | 167.5 | | ≧20T | $3 \times 10^6$ | 1348 |
| A27 | 2.90 | 1.00 | | 137.5 | 167.5 | | ≧20T | | 1356 |
| A28 | 1.90 | 0.80 | | 137.5 | 167.5 | | ≧20T | | 1332 |
| A29 | 1.70 | 0.55 | | 137.5 | 175.0 | | ≧20T | | 1377 |
| A30 | 1.60 | 0.75 | | 150.0 | 187.5 | | ≧20T | | 1378 |
| A31 | 2.50 | 1.20 | | 137.5 | 167.5 | | ≧20T | | 1332 |
| A32 | 1.80 | 0.95 | | 150.0 | 175.0 | | ≧20T | | 1364 |
| A33 | 2.00 | 1.00 | | 137.5 | 167.5 | | ≧20T | | 1305 |
| A34 | 1.50 | 0.60 | | 150.0 | 187.5 | | ≧20T | | 1364 |
| B1 | 5.80 | 3.50 | | 100.0 | 137.5 | | 11~13T | $2 \times 10^5$ | 1180 |
| B2 | | | 10.0 | | | 150 | | | |

As seen from Table 2, the abrasion loss of steel B1 according to the prior art was 5.8 μm for the quenched-and-tempered specimen, 3.5 μm for the nitrided specimen, and 10.0 μm for the Cr-plated specimen. On the other hand, the abrasion losses of steels A01 to A19 according to the present invention were 1.7–3.5 μm for the quenched-and-tempered specimens and 0.7–2.2 μm for the nitrided specimens (the hardness of the nitrided case was over Hv 1000 in all cases), the values confirming excellent wear resistance. The reason for the superior wear resistance of the steels according to the present invention, with or without the nitriding treatment, is considered to be the formation of larger amounts of chromium carbides (slightly above 2.0 μm in average particle size), as compared with steel B1 according to the prior art, due to the compositions of 0.55–1.10% C. and 12.0–25% Cr. Addition of Mo, V and Nb leads to formation of fine carbides, so that wear resistance is enhanced more as the amounts of these elements are larger.

Beside, the carbide-forming elements Cr, Mo, V and Nb are ferrite-forming elements, and addition of large amounts of these elements causes, depending on the C and Ni contents, precipitation of α phase (ferrite) (steels A01, A02, A07, A08 and A09 according to the present invention), resulting in inferior wear resistance as compared to those of uniform martensite structures free of precipitation of α phase (steels A03 to A06 and A10 to A12 according to the present invention). Accordingly, the addition of Ni is important for obtaining excellent wear resistance, in the point of strengthening the matrix while precipitating large amounts of carbides.

The enhancement of wear resistance by the gas nitriding treatment, to the level by far superior to the wear resistance of quenched-and-tempered specimens, is attributable to precipitation hardening (Hv 1000 or above) by precipitation of fine chromium nitride in the matrix, conversion of chromium carbide into chromium carbonitride or chromium nitride, and wavy precipitates (considered to be grain boundary cementite) formed from carbon excluded from carbides.

In addition, steels A20 to A34 according to the present invention showed an abrasion depth for quenched-and-tempered specimens of 1.20–4.00 μm, as contrasted to the value of 5.8 μm attained with steel B1 according to the prior art. The gas-nitrided specimens of the steels of the present invention showed an abrasion depth of 0.20–2.00 μm, as contrasted to 3.5 μm of steel B1. Thus, in both cases, the results confirmed the excellent wear resistance of the steels according to the present invention.

The results of the seizure test will now be discussed.

For piston rings, a good scuffing resistance of a seizure load of at least 125.0 kg is sufficient to produce good results, without generation of scuffing, in actual engine operations. On the other hand, when a material having a seizure load of less than 112.5 kg is used, top rings are scuffed and fatally damaged under such severe engine operation conditions that an oil film is partly broken. Oil ring and side rails are lightly marred vertically, if not so heavily as the top rings. Therefore, a material having a higher seizure load can be used in a thermally severer engine operation condition.

The nitrided specimens of the steels according to the present invention showed a scuffing resistance comparable or superior to that of steel B1 according to the prior art. Particularly, steels A03 to A05, A07 and A08 of the present invention showed a scuffing resistance of 167.5 kg, and steels A06 and A10 to A12 of the invention showed a superior scuffing resistance of 187.5 kg. The reason why these steels particularly show the excellent scuffing resistance is that granular chromium carbonitride or chromium nitride which scarcely adheres to the opponent member projects slightly from the matrix at the sliding surface to prevent adhesion of the matrix to the opponent member, and traces of adhesion, if present between the opponent member and the matrix, are cut off by the granular chromium carbonitride or chromium nitride, thereby preventing occurrence of heavy seizure.

The seizure loads of steels A20 to A34 were 137.5 to 150.0 kg for quenched-and-tempered specimens and 167.5 to 187.5 kg for gas-nitrided specimens, as contrasted respectively to 100.0 kg and 137.5 kg of the specimens of the conventional steels. In both cases of quenched-and-tempered specimens and the gas-nitrided specimens, it was confirmed that the steels according to the present invention have excellent scuffing resistance.

In fitting a piston ring into the ring groove of a piston, the joint gap of the piston ring having a given radial thickness (T size, mm) is enlarged to 10 times the radial thickness (hereinafter referred to simply as 10 T). Therefore, the piston ring must at least have a fitting strength of more than 10 T. Though piston rings formed of the quenched-and-tempered specimens show sufficient fitting strength, piston rings formed of the nitrided specimen of steel B1 according to the prior art show a marginal fitting strength of 11 to 13 T because of the brittle diffusion-hardened layer, and may be broken under some variations in the material and the enlarging amount of the joint gap. In the case of the steels of the present invention, on the other hand, piston rings for a bore diameter of 86 mm (B size 2.0 mm, T size 3.15 mm, and nitriding depth 90 μm) have, as shown in Table 2, a superior fitting strength of at least 20 T, as contrasted to 11–13 T of steel B1 of the prior art.

The hardnesses of gas-nitrided specimens are also shown in Table 2. While steel B1 according to the prior art showed a hardness of 1180, steels A20 to A34 of the present invention had a hardness of 1305 to 1450, confirming the high hardness of the nitrided case of the steels of the present invention.

Piston rings to which fatigue strength matters, such as keystone type rings, are subjected to breakage, particularly where a brittle material such as a gas-nitrided material is used and where a brittle composite plating is applied to a surface area for sliding contact with the cylinder wall. Gas-nitrided piston rings were served to a fatigue test in a diluted aqueous solution of sulfuric acid under an amplitude stress of 50 kgf/mm. The results are shown in Table 2. While steel B1 of the prior art showed a fatigue strength of $2\times10^5$, steels A05, A06, all and A12 of the present invention showed a fatigue strength of $5\times10^5$, steels A04 and A10 showed $7\times10^5$, steel A16 showed $1\times10^6$, steels A17 and A18 showed $2\times10^6$, and steel A19 showed $3\times10^6$, indicating a marked improvement in fatigue strength. The excellent fitting strength and fatigue strength are attributable to the strengthening of the matrix of the gas-nitrided diffusion-hardened case by the addition of 12.0–25.0% of Cr.

Top rings formed from steel A21 accordintg to the present invention and top rings formed from steel A14 according to the present invention (different from steel A21 only in that steel A14 do not contain Al) were individually fitted to pistons for a 2000-cc in-line four-cylinder engine, and a 150-hr endurance test was carried out. Upon this test, the abrasion loss of the cylinder bore used with the top ring of steel A14 was taken as 1.00, and the abrasion loss of the cylinder bore used with the top ring of steel A21 was represented in terms of its ratio to the former abrasion loss. The result is shown in Table 3.

TABLE 3

| | Steel A21 | Steel A14 |
|---|---|---|
| Cylinder bore abrasion ratio | 0.80 | 1.00 |

As seen from Table 3, the piston rings formed of the steel A21 containing Al produced less abrasion loss of the cylinder bore, as compared to the piston rings of the steel A14 containing no Al. This is due to spheroidization of carbide particles and uniformization of carbide particle diameter (reduction of the amount of coarse carbide particles) upon the quenching and tempering process, increase in the hardness of the nitrided case by precipitation of fine particles of A1N upon gas nitriding, or the like.

The reasons for the test results shown above will now be explained in detail below, based on FIGS. 1 to 5 and Table 4.

Figure 2:
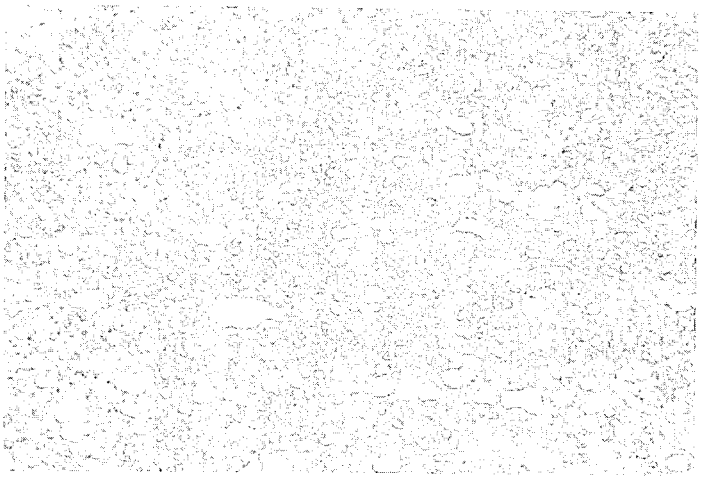
FIG. 2 is a micrograph (400 magnifications) showing the matallic structure of another steel according to the present invention.
Figure 3:
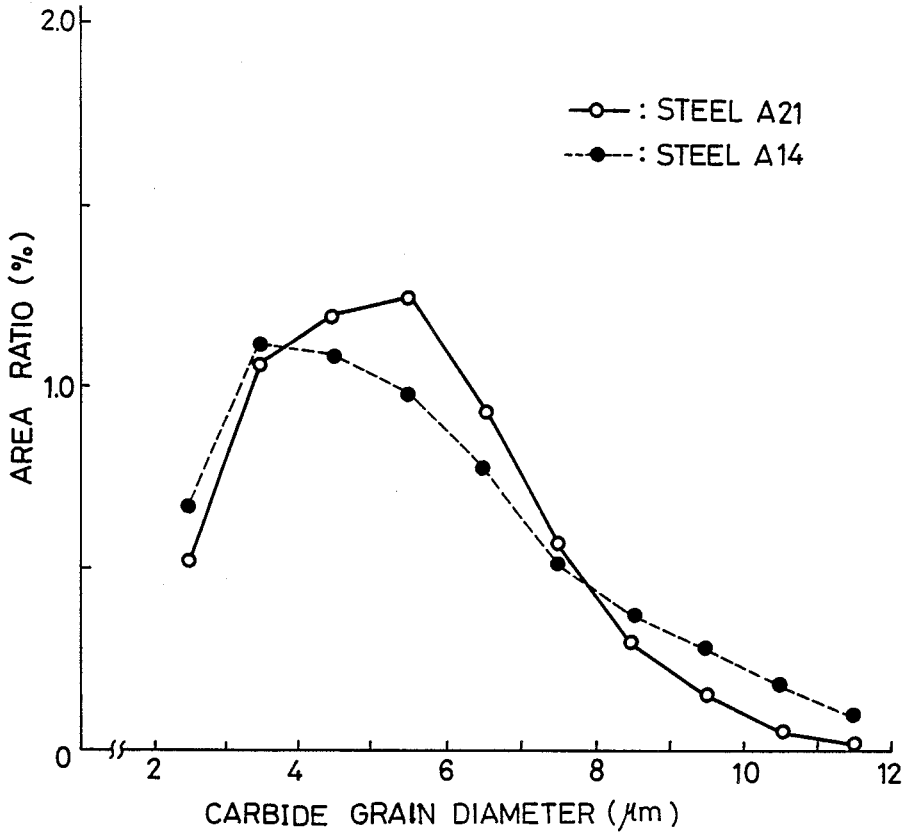
FIG. 3 is a diagram showing the relationship between carbide grain diameter and area ratio, of steels according to the present invention.

FIG. 1 is a micrograph (×400) showing the metallic structure of steel A21 according to the present invention, FIG. 2 is a micrograph (×400) showing the metallic structure of steel A14, FIG. 3 is diagram showing the relationship between carbide particle diameter, at least 2 μm, and area ratio, for the steels according to the invention, and Table 4 shows a comparison between the steels A21 and A14 according to the present invention in respect of average particle diameter of carbides and area ratio (the proportion of area of carbide particles present in the field when observed under a microscope).

TABLE 4

| | Steel A21 | Steel A14 |
|---|---|---|
| Average particle diameter (μm) | 3.9 | 3.4 |
| Area ratio of carbide particles at least 8 μm in diameter (%) | 0.54 | 0.98 |

As clearly seen from FIG. 1 and Tables 3 and 4, in steel A21 containing Al in accordance with the present invention, the chromium carbide particles are somewhat rounded in shape in compared with those in the steel A14 which contains no Al, and the area ratio of coarse carbide particles of the steel A21, 0.54%, is as low as 0.58% of the steel A14, so that cylinder bore abrasion in the steel A21 can be decreased to 4/5 in compared with that in the steel A14.

The addition of Al, as distinguished from the addition of other carbide-forming elements (C, Cr, Mo, V, Nb, W), has the advantageous features that a desired remarkable improvement in wear resistance and scuffing resistance can be achieved by the addition of a small amount of Al, and the Al addition prevents increase of cylinder bore abrasion and does not cause substantial reduction in hot workability.

The above-mentioned effects obtained with the steels according to the present invention will be explained more in detail below, in connection with the application of the steels to piston rings.

(1) Top ring (first compression ring)

Figure 4:
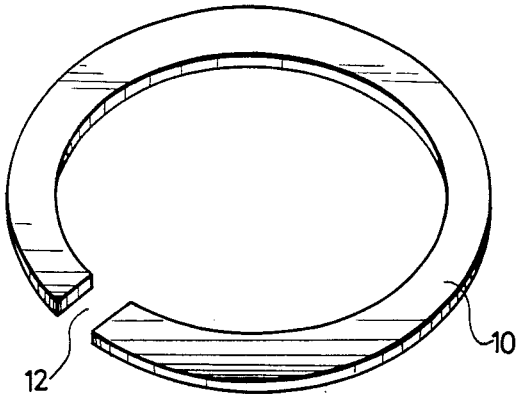
FIG. 4 is a perspective view of a compression spring.

FIG. 4 shows a perspective view of a top ring 10. Of piston rings, the top ring is most severely required to have good scuffing resistance, the required value varying widely depending on the engine in which the top ring is to be used. A top ring formed of the conventional 13 Cr martensitic stainless steel is susceptible to scuffing if used without gas nitriding treatment. Therefore, the top ring of 13 Cr martensitic stainless steel has been used after gas-nitriding the top ring or surface-treating the top ring only in a surface area for sliding contact with the cylinder bore by hard chromium plating, thermal spraying, Ni-P based composite plating or the like.

The top ring formed of the steel according to the present invention, even as-quenched-and-tempered, shows a scuffing resistance comparable to that of the gas-nitrided product of 13 Cr martensitic stainless steel and, therefore, can be satisfactorily used as it is. Even in engines with severer requirements for scuffing resistance, the steel of the present invention, when surface treated, gives a scuffing resistance superior to that of the hard chromium plated conventional steel, and produces good results without generation of scuffing.

As for wear resistance, also, the conventional 13 Cr martensitic stainless steel is not necessarily satisfactory, and it has been a common practice to adopt a large nitriding depth of 90 or 120 μm for the top ring to be used in engines with severe requirements. However, an increase in the nitriding depth leads to a lowering in fatigue stengrh and fitting strength at the joint gap 12 of the ring 10, and mey therefore cause breakage of the ring.

On the other hand, the steel according to the present invention has an improved strength and, even with the same nitriding depth as in the prior art, is free from the ring breakage problem. In addition, because of the marked improvement of the wear resistance, the nitriding depth can be decreased, leading to a further higher strength, a shorter gas nitriding time and an easier mass production of the top rings, Besides, the decrease of wear loss minimizes the deterioration in oil consumption performance and blow-by gas performance associated with wear, and prevents the deteriorations in total engine performance.

(ii) Oil ring

An oil ring is accompanied by a high contact surface pressure due to tension and, in some engines, may wear more heavily than a top ring. Since a lowering in the contact surface pressure due to the wear increases oil cosumption, the wear resistance requirements for the oil rings are considerably severe. The steel according to the present invention has eminent wear resistance and is able to meet the requirement.

Figure 5:
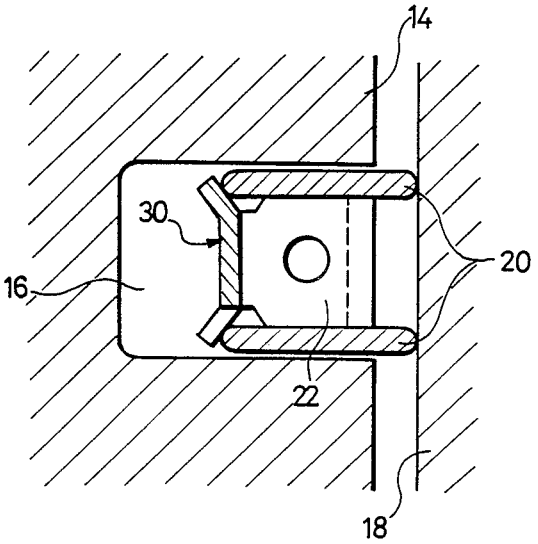
FIG. 5 is a vertical cross-sectional view of a three pieces combination type oil ring in a sliding condition.

FIG. 5 is a cross-sectional view of a three pieces combination type of oil ring 30 in a sliding condition, in which are shown an oil ring groove of a piston, a cylinder bore 18, side rails 20 and an spacer-expander 22. For the side rails 20 of this type of oil ring 30, the depth of nitriding, if carried out, is at most 30–60 μm due to the restriction imposed for maintaining high strength. In an engine used for a long time, therefore, the scuffing resistance and wear resistance of the base steel (quenched and tempered steel) exposed due to wear-out of the nitrided case are important factors. The steel according to the present invention gives good results on this point, as mentioned above in connection with the top ring.

In the case of the three pieces combination type oil ring 30, not only the surface area for sliding contact with the cylinder bore 18 but also the contact portions between the side rails 20 and ear portions of the spacer-expander 22 are required to have good wear resistance. This requirement also is met by the steel according to the present invention.

Next, rocker arm pads were prepared using the steels A02, A05 and A10 according to the present invention and comparative steel B3 (corresponds to SKD 11). These pads were subjected to quenching and tempering followed by subjected to salt bath nitriding operation at 530°–590° C. for 3 hours. Then rocker arm pads thus obtained were served to the motoring test under the following conditions.

| Motoring test | |
|---|---|
| Rotational speed of internal combustion engine | 2000 r.p.m. |
| Time | 200 hours |
| Valve spring load | More than 150% (in compared with fitting load of in mass-produced engine) |
| Lubricating oil | Deteriorated oil by long-term use |

-continued

| Motoring test | |
|---|---|
| Cam shaft (opponent material) | Cast iron alloy |

The abrasion loss at the sliding surface of each of the rocker arm pad and cam were measured.

The results are shown in Table 5.

TABLE 5

| Test steel | Abrasion loss of rocker arm pad (μm) | Abrasion loss of cam (μm) |
|---|---|---|
| A02 | 3 | 5 |
| A05 | 2 | 6 |
| A10 | 1.5 | 8 |
| B3 | 6 | 80 |

Table 6 shows a comparison between the steels A02, A05 and A10 according to the present invention and the comparative steel B3 in respect of area ratio of the carbide particles.

TABLE 6

| Test steels | Area ratio of carbide particles at least 2 μm in diameter (%) | Area ratio of carbide particles at least 8 μm in diameter (%) |
|---|---|---|
| A02 | 7.6 | 0.7 |
| A05 | 8.1 | 0.9 |
| A10 | 7.5 | 0.8 |
| B3 | 5.2 | 1.8 |

As seen from Tables 5 and 6, the abrasion loss of the steels according to the present invention show excellent wear resistance in compared with the abrasion loss of the conventional steel. The reason for the excellent wear resistance of the steels according to the present invention is considered to be the enhancement of wear resistance due to the formation of increased amount of carbides and the decrease of attacking the opponent material due to the refining of the carbide particles (decrease of coarse carbides).

Further, pinion shafts were prepared using the steel A05 according to the present invention and conventional steels B4(SCr 415) and B5 (SCM 440). Pinion shafts made of steels A05 and B5 were subjected to gas soft-nitriding treatment after quenching and tempering. Pinion shaft made of steel B4 was subjected to carburizing, quenching and tempering but not nitriding. Then pinion shafts thus obtained were assembled in the differential gear assembly of a front-engine front-wheel-drive vehicle. Test drive under the condition in which pinion gears moves relatively and actively on the pinion shaft due to the differential movement was conducted with respect to each of the pinion shaft. After drive test of 50.000 km, each of the pinion shaft was disassembled from the differential gear assembly and abrasion losses were measured. The results are shown in FIG. 6.

Figure 6:
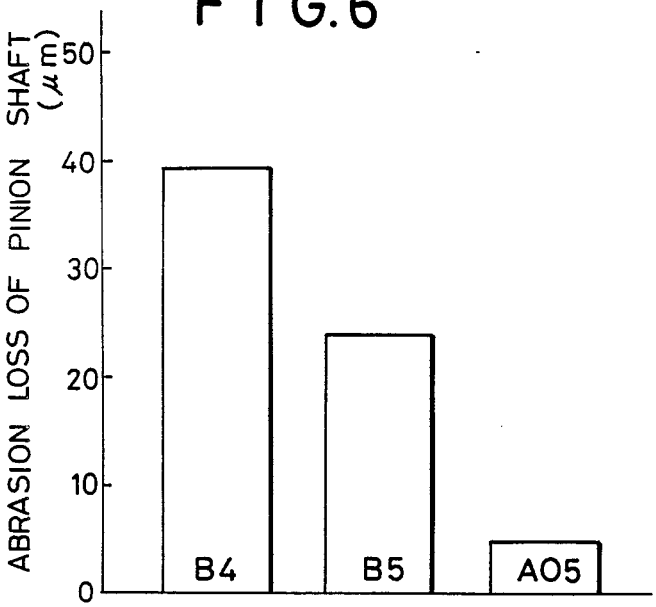
FIG. 6 is a diagram showing abrasion losses of the steel according to the present invention and conventional steels.

As seen from FIG. 6, while the abrasion losses of the pinion shafts made of conventional steel B4 and B5 (gas soft-nitrided) are as large as 40 μm and 25 μm, respectively, the abrasion loss of the pinion shaft made of steel A05 according the present invention is 5 μm, which is as low as 1/5–$\frac{1}{8}$ of those of the conventional steels.

Figure 7:
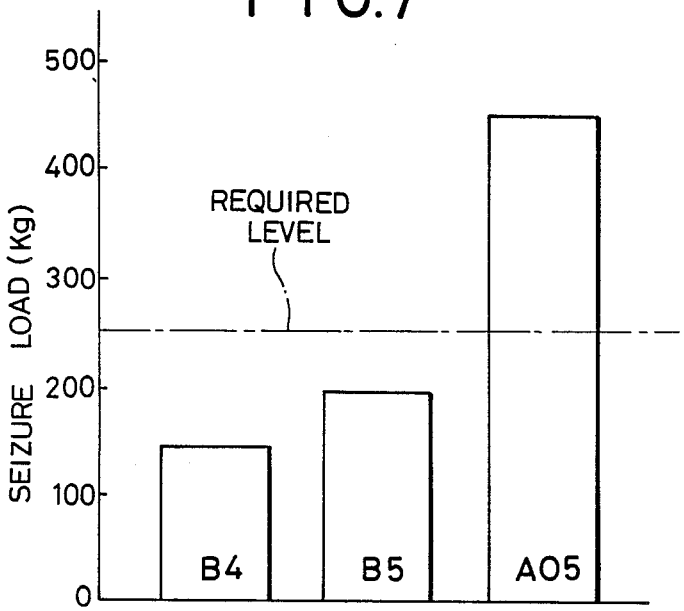
FIG. 7 is a diagram showing seizure loads of the steel according to the present invention and conventional steels.

Specimens made from the above-noted pinion shafts were served to the seizure test. Seizure tests were carried out by mechanical testing laboratory type frictional abrasion tester under the condition as stated earlier. The seizure load measured are shown in FIG. 7. It is to be noted that seizure may not occur on the pinion shafts made of the steels which show the abrasion load of more than 250 kg (required level) in accordance with this test even when the pinion shafts are subjected to be operated under the driving condition of vehicles in which the differential movement may frequently occur. Accordingly, the results confirms the excellent seizure resistance of the steels according to the present invention.

Table 7 shows a comparison between the steels A03, A05, A22 and A26 according to the present invention and the conventional steels B4 and B5 in respect of abrasion loss measured after the drive test and sezure load measured on the frictional abrasion test.

TABLE 7

| | Abrasion loss (μm) | Seizure load (kg) |
|---|---|---|
| A03 | 2.8 | 450 |
| A05 | 3.0 | 450 |
| A22 | 5.0 | 450 |
| A26 | 2.2 | 450 |
| B4 | 40.0 | 150 |
| B5 | 25.0 | 200 |

As seen from Table 7 , Abrasion loss of the steels according to the present invention show excellent wear resistance in compared with the abrasion loss of the conventional steels B4 (carburized) and B5 (gas soft-nitrided) and seizure load of the steels according to the present invention is excellent in compared with the seizure load of the conventional steels.

A pinion shaft which is made from a steel including, by weight, 0.55–1.10% of C and 12.00–25.0% of Cr, having fine chromium carbide particles of 2–12 μm in diameter being dispersed in quenched-and-tempered martensite structure at area ratio of 0.2–8.0%, having a nitride layer of more than 2 μm on the surface thereof and a diffusion layer of more than 20 μm under said nitride layer obtained by soft-nitriding treatment shows excellent wear resistance and seizure resistance. The reason for the excellent wear resistance and seizure resistance of the steels according to the present invention is considered to be obtained by the existance of fine chromium carbide particles of 2–12 μm in diameter formed by soft-nitriding treatment and by the existance of wavy precipitates (considered to be grain boundary cementite) formed from carbon excluded form carbides.

Though the steel of the present invention shows satisfactory wear resistance even when used as it is, the effect can be remarkably augmented by a surface treatment such as nitriding, plating and thermal spraying. It is preferable to heat-treat the steel of the invention prior to nitriding. The heat treatment may be, for instance, a quenching and tempering treatment (with the subsequent nitriding serving also as tempering). The nitriding treatment, which is applied to a surface of the steel including the surface area to be brought into sliding contact, may be any of gas nitriding, gas soft-nitriding, salt bath nitriding, tufftriding and ion nitriding.

As has been detailed above, the steel according to the present invention contains an increased amount of Cr, for further enhancement of the wear resistance and service life of the conventional martensitic stainless steels, and shows formation of chromium carbide in a larger amount than in the conventional steels and a remarkable enhancement of wear resistance achieved by spheroidizing of the carbide particles and uniformization of particle size. By restriction of C, Si and Mn contents and addition of Ni, Mo, V or Nb, the steel according to the present invention shows further enhanced wear resistance, scuffing resistance, fitting resistance and fatigue resistance while retaining the good high-temperature resistance, corrosion resistance and scuffing resistance of the conventional steels. When the steel of the present invention is used for piston rings, longer service life of the piston rings is ensured. The above-mentioned effects is further augmented by a surface treatment such as nitriding, plating and thermal spraying applied to the steel according to the present invention.

Furthermore, the steel according to the present invention is based on the addition of 0.05–1.10% of Al, the optimum Al content range found in connection with the contents of C, Si, Mn, Cr or the like, whereby carbide particles are spheroidized and the particle size is uniformized, leading to higher wear resistance and scuffing resistance. By a surface treatment such as gas nitriding, Al dissolved in the matrix is precipitated as fine AlN particles, resulting in further enhancement of wear resistance and scuffing resistance. Moreover, the steel according to the present invention has many other effects in remarkably increasing the fitting strength of piston rings, showing high hardness, being superior to the conventional steels in fatigue strength, and so on.

What is claimed is:

1. A steel having good wear resistance consisting essentially of, by weight, 0.55–1.10% of C, up to 2.0% of Si, up to 2.0% of Mn, 12.0–23.5% of Cr and 0.05–1.10% of Al, the remainder being Fe and inevitable impurities, said steel having fine chromium carbide particles of 0.2–8.0% by area ratio with a size of 2–12 μm in average particle size.

2. A steel according to claim 1, wherein said steel consists essentially of, by weight, 0.55–1.10% of C, up to 2.0% of Si, up to 2.0% of Mn, 19.5–23.5% of Cr and 0.05–1.10% of Al, the remainder being Fe and inevitable impurities.

3. A steel according to claim 1, wherein said steel consists essentially of, by weight, 0.55–1.10% of C, up to 2.0% of Si, up to 2.0% of Mn, 12.0–23.5% of Cr, 0.05–1.10% of Al and a member or members selected from the group consisting of 0.2–2.0% of Ni, 0.2–3.0% of Mo, 0.1–1.5% of V and 0.05–0.70% of Nb, the remainder being Fe and inevitable impurities.

4. A steel according to claim 1, wherein said steel consists essentially of, by weight, 0.55–1.10% C, up to 2.0% of Si, up to 2.0% of Mn, 19.5–23.5% of Cr, 0.05–1.10% of Al and a member or members selected from the group consisting of 0.1–1.0% of Ni, 0.2–3.0% of Mo, 0.1–1.5% of V and 0.5–0.70% of Nb, the remainder being Fe and inevitable impurities.

5. A wrought steel having good wear resistance consisting essentially of, by weight, 0.55–1.10% of C, up to 2.0% of Si, up to 2.0% of Mn, 12.0–23.5% of Cr and 0.05–1.10% of Al, the remainder being Fe and inevitable impurities, said steel having fine chromium carbide particles of 2–12 μm in average particle size being dispersed in quenched-and-tempered martensite structure at area ratio of 0.2–8.0%, said steel being surface treated at least in a surface area for sliding contact with an opponent member.

6. A wrought steel according to claim 5, wherein said steel consists essentially of, by weight, 0.55–1.10% of C, up to 2.0% of Si, up to 2.0% of Mn, 19.5–23.5% of Cr and 0.05–1.10% of Al, the remainder being Fe and inevitable impurities.

7. A wrought steel according to claim 5, wherein said steel consists essentially of, by weight, 0.55–1.10% of C, up to 2.0% of Si, up to 2.0% Mn, 12.0–23.5% of Cr, 0.05–1.10% of Al and a member or members selected from the group consisting of 0.2–2.0% of Ni, 0.2–3.0% of Mo, 0.1–1.5% of V and 0.05–0.70% of Nb, the remainder being Fe and inevitable impurities.

8. A wrought steel according to claim 5, wherein said steel consists essentially of, by weight, 0.55–1.10% of C, up to 2.0% of Si, up to 2.0% of Mn, 19.5–23.5% of Cr, 0.05–1.10% of Al and a member or members selected from the group consisting of 0.2–2.0% of Ni, 0.2–3.0% of Mo, 0.1–1.5% of V and 0.05%–0.70% of Nb, the remainder being Fe and inevitable impurities.

* * * * *